United States Patent [19]

Schaefer

[11] 4,045,946

[45] Sept. 6, 1977

[54] APPARATUS FOR CONTINUOUSLY FORMING AND FILLING TAMPON SACKS

[75] Inventor: Jean E. Schaefer, Cincinnati, Ohio

[73] Assignee: The Procter & Gamble Company, Cincinnati, Ohio

[21] Appl. No.: 678,998

[22] Filed: Apr. 21, 1976

Related U.S. Application Data

[62] Division of Ser. No. 484,813, July 1, 1974, Pat. No. 3,982,374.

[51] Int. Cl.[2] ..... B65B 9/12

[52] U.S. Cl. ..... 53/180 M; 53/180 R

[58] Field of Search ..... 53/180, 28; 19/144.5

[56] References Cited

U.S. PATENT DOCUMENTS

| | | | |
|---|---|---|---|
| 2,976,657 | 3/1961 | Cloud | 53/180 X |
| 3,040,490 | 6/1962 | Virta | 53/28 X |
| 3,057,129 | 10/1962 | Meissner | 53/28 |
| 3,126,682 | 3/1964 | Krance | 53/180 X |
| 3,426,499 | 2/1969 | Paige | 53/28 |
| 3,657,856 | 4/1972 | Planner | 53/28 |

*Primary Examiner*—Travis S. McGehee

*Attorney, Agent, or Firm*—Melville, Strasser, Foster & Hoffman

[57] ABSTRACT

An apparatus for continuously forming and filling tampon overwraps or sacks wherein a web of pouch forming material is unwound from a supply roll, passed through an adhesive printer which applies spaced apart transverse stripes of heat activatable adhesive which ultimately form end seals for the sacks, the adhesive being dried on a drying drum having raised portions which coincide with the transverse stripes of adhesive. The web proceeds to a hollow tube forming mandrel and is formed around the mandrel with the longitudinal edges of the web overlapped and sealed to form the longitudinal seam of the tubing. The formed tubing is tangentially received by a rotating turret having a plurality of pleating and sealing stations spaced about its periphery, the spacing between adjoining stations corresponding to the spacing of the transverse stripes of adhesive on the tubing. Each station has a pleater which sequentially engages and gathers the tubing and sealing jaws which engage and seal the gathered tubing in the areas of the transverse adhesive stripes to form a continuous series of sacks. As the leading end seal of each successive sack is formed, a charge of particulate absorptive material is introduced through the tubing into the sack being formed, the hollow mandrel having a funnel-like hopper into which measured increments of the absorptive material are deposited, an air jet in the mandrel acting to propel the material from the mandrel and through the tubing so that the material comes to rest against the leading end seal of the sack being formed, whereupon the formation of the next successive end seal completes the sack and encloses the deposited charge of material. Adjustment means are provided to establish the pitch distance between adjacent sets of sealing jaws as the turret rotates to insure accurate registry of the transverse adhesive stripes with the sealing jaws both during start-up and normal operation, and phase adjustment means are also provided to initially synchronize turret rotation with tube movement.

26 Claims, 21 Drawing Figures

23a
14a
52
54
50
56
44
62
21
57
60
63
V
61
14

23b
14b 37
39
38
17
32
33
26
29
39c
39a
42
40
41
39b
41a

APPARATUS FOR CONTINUOUSLY FORMING AND FILLING TAMPON SACKS

This is a division of application Ser. No. 484,813, filed July 1, 1974, now U.S. Pat. No. 3,982,374.

BACKGROUND OF THE INVENTION

The present invention relates to the manufacture of tampons and has to do more particularly with the formation of closed tubular overwraps or sacks, as they will be referred to herein, containing an absorptive aggregate. Tampons of the type with which this invention is concerned are fully disclosed in commonly owned U.S. Pat. No. 3,815,601 of Jean E. Schaefer entitled "Catamenial Aggregate Absorbent Body" which issued on June 11, 1974. In accordance with the teachings of the said patent, the tampon comprises an aggregate composed of individual pieces of absorbent, foam-like material encased within a flexible, fluid-permeable overwrap. The overwrap is in the nature of a tubular sack closed at its opposite ends, the ends of the sack preferably being gathered inwardly and secured to form end seals. A withdrawal string is attached to one end of the sack, whereupon the sack which is preferably elongated, is formed into rosette shape by displacing the distal end of the sack inwardly, i.e., the end of the sack opposite the withdrawal string is displaced inwardly relative to the longitudinal axis of the sack to form a cavity in the overwrap. This forms a tampon structure in which the absorbent aggregate is encased by an overwrap having an exterior portion forming the exterior surface of the tampon and a re-entrant portion forming the surface of the cavity. Subsequent to the formation of the tampon into rosette shape, it is radially compressed and enclosed in a tube-type inserter by means of which it can be inserted into a vagina, as will be understood by those familiar with the tampon art.

The present invention is concerned with apparatus and procedures for forming and filling the tubular sacks in a continuous operation, commencing with a continuous web of sack-forming material which is pre-glued, tubed, and the tubing formed into a continuous series of filled sacks which are in condition to be conveyed to additional processing apparatus for the completion of the manufacturing operations, including the application of the withdrawal strings and the severance of the sacks into individual units, followed by their formation into the desired rosette shape and insertion into their dispensing tubes.

It is to be understood at the outset that the present invention, while directed specifically to the manufacture of tampons of the character described, will find utility in other applications wherein it is desired to package measured increments of material in a closed and sealed sack or overwrap. Consequently, while the invention will be described in connection with the manufacture of tampons, it should be readily apparent that the invention will have utility in other fields wherein a similar type of package is desired.

SUMMARY OF THE INVENTION

In accordance with the present invention, apparatus is provided which will continuously and automatically form a supply of web stock into a tubular sleeve, including the preprinting of spaced apart transverse stripes of heat activatable adhesive on the web and the drying of the applied adhesive stripes prior to the tubing of the web. To this end, the apparatus includes an adhesive printer which applies the transverse adhesive stripes in time relation to the movement of the web stock, the advancing web then passing around a drying drum having a series of elevated drying bars positioned to coincide with the adhesive stripes, the drying unit including a grooved applicator roll for juxtaposing the web to the drum without interfering with the adhesive stripes.

The tube forming section of the apparatus contemplates the use of a hollow mandrel about which the web is tubed, the hollow mandrel also serving as the means for introducing contents, such as foam aggregate, into the sacks being formed. To this end, the mandrel is provided with a funnel-like hopper overlying an opening in the mandrel through which measured increments of the material to be packaged are introduced into the hollow interior of the mandrel. While not forming a part of the present invention, it will be understood that the hollow mandrel will be fed by a metering means which delivers measured increments of the filling material in timed relation to the movement of the web and the formation of the sacks. As the metered increments of material are deposited within the hollow mandrel, an intermittently operated air jet acts to propel the filling material longitudinally through the mandrel and into the tubed web which extends between the mandrel and the turret on which the tubing is formed into individual sacks.

In accordance with the invention, an adhesive applicator overlies the mandrel and is positioned to apply one or more narrow filaments of adhesive to a longitudinal edge of the web as the web is being tubed about the mandrel, the longitudinal edges of the web being overlapped and juxtaposed with the filaments of adhesive compressed therebetween to form a longitudinal seam. Preferably, the seam-forming adhesive will be a hot melt; and chilling means are provided to set the adhesive immediately following the formation of the seam. To this end, a chilled roll is positioned to contact the outer surface of the tube in the area of the longitudinal seam, and the mandrel itself is provided with an opposing sealing roller positioned to contact the inner surface of the tube in the area of the seam. The latter roll is chilled by means of a duct in the mandrel through which cooling air under pressure is supplied.

The invention further contemplates a rotating turret driven in timed relation to the movement of the web which acts to withdraw the tubed web from the mandrel and form it into a series of interconnected sacks. The turret has a series of tube engaging stations each of which includes a pleater and a pair of sealing jaws which sequentially close and open as the turret rotates. Each station is spaced apart by a distance such that a sack will be formed between adjoining stations. Each pleator comprises a fixed jaw and a movable jaw which opens and closes in timed relation to the movement of the turret, the pleater jaws mounting interdigitating sets of pleating fingers which gather and fold the tube into a series of pleats at intervals corresponding to the location of the pre-applied transverse stripes of adhesive which were applied on the side of the web which defines the outside of the formed tube. The sealing jaws, which are heated to reactivate the transverse adhesive stripes, are positioned immediately adjacent the pleating jaws and, once the pleating jaws close, the sealing jaws then close to tightly engage the pleats in the areas of the adhesive stripes and form the end seals for the sacks.

Preferably, both the movable pleating jaw and the sealing jaws are pneumatically actuated and controlled by cam actuated valves carried by the rotating turret. In a preferred embodiment of the invention, the centermost pleating fingers are of greater length than the outermost fingers and are spring biased so as to progressively gather the tubing as the pleats are formed.

The turret is mounted on and rotated by a vertically disposed drive shaft driven in timed relation to the web feeding and tube forming portions of the apparatus, and preferably the drive shaft for the turret mounts a timing disc for intermittently operating the air jet which propels the aggregate from the mandrel into the sacks being formed. Phase adjusting means are provided to initially synchronize turret rotation with tube movement, and the pleating stations are radially adjustable relative to the turret to vary the pitch distance between adjacent sets of sealing jaws to provide accurate registry of the sealing jaws with the transverse adhesive stripes on the tubing. In addition, the turret shaft mounts a vertically adjustable conical hub which, acting through spring-biased push rods, controls a series of adjustable plates lying between adjacent stations on the turret, the plates being movable outwardly to vary the effective pitch distance between adjacent stations during start-up so that the transverse stripes of adhesive which form the end seals of the sacks will properly register with the pleater and sealing jaws, the plates being retracted when filling commences.

As each station on the turret completes its cycle of operation, the pleater and sealing jaws will be sequentially opened and the filled and sealed sack released for discharge from the apparatus, preferably through a discharge conduit by means of which the interconnected series of sacks is removed for storage or for delivery directly to other processing apparatus.

DESCRIPTION OF THE PREFERRED EMBODIMENT

Figure 1:
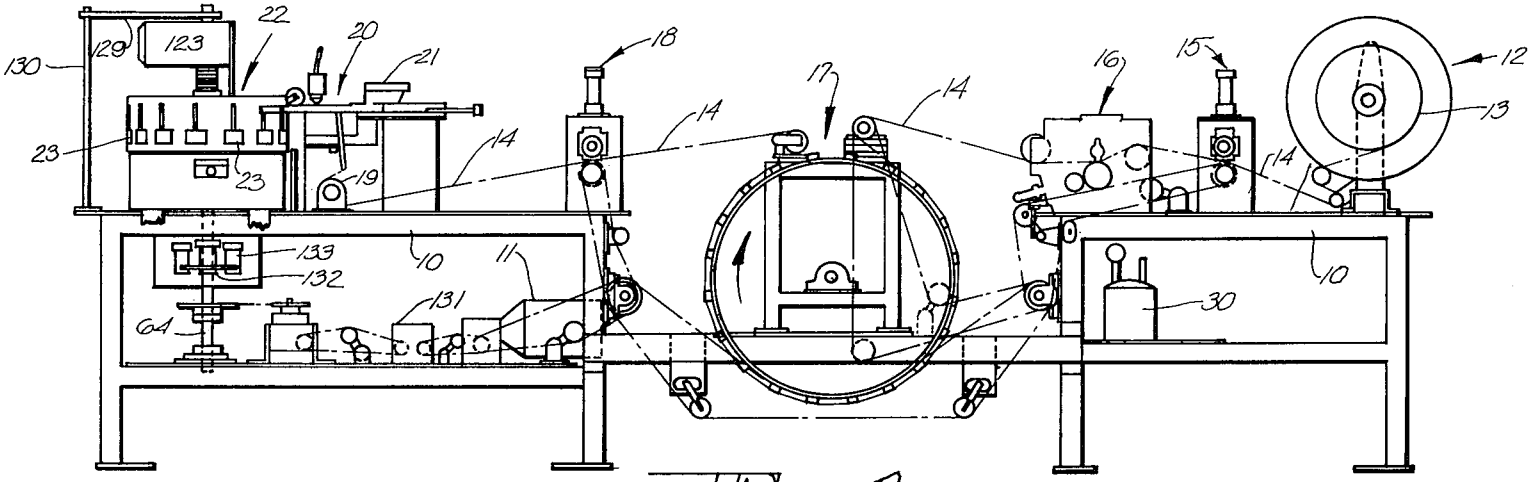
FIG. 1 is a side elevational view illustrating the general organization of apparatus in accordance with the invention.
Figure 2:
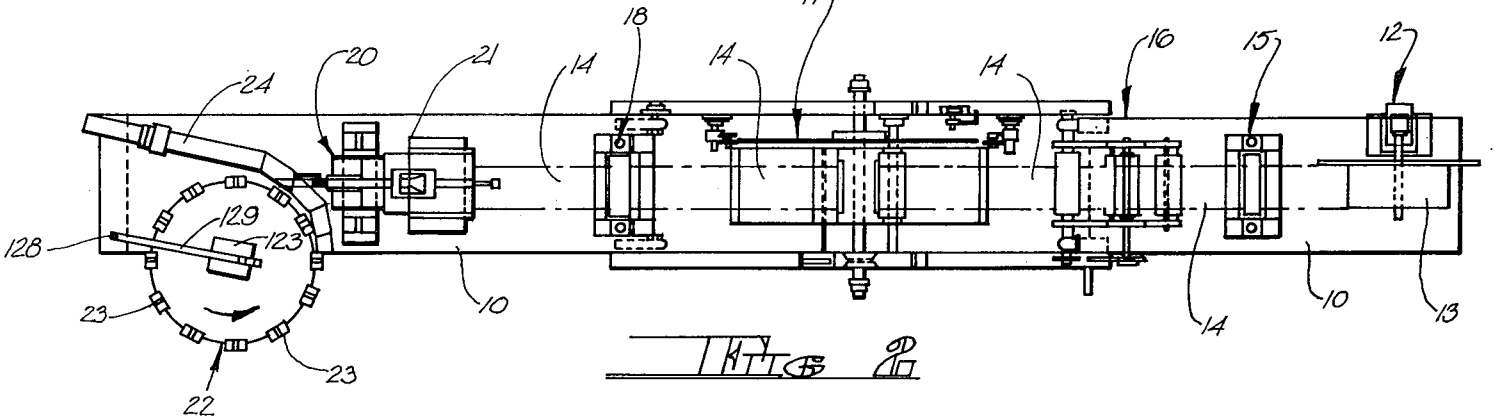
FIG. 2 is a plan view of the apparatus illustrated in FIG. 1.

For a general understanding of the organization and operation of the apparatus, reference is first made to FIGS. 1 and 2 of the drawings wherein the machine frame on which the various operating components are mounted is indicated generally at 10. Preferably, all of the various operating components will be driven by a prime mover 11 acting through the usual speed reducers, gear boxes and drive trains, as will be readily understood by the worker in the art. While representative drive trains have been illustrated, they do not constitute a limitation on the invention and will not be described in detail other than to note a preference for a drive system operating from a single power source, thereby simplifying the timing of the various components.

An unwind stand 12 is provided at the leading end of the apparatus mounting a supply roll 13 of web stock which is to be formed into tubed and sealed sacks or pouches. The web 14 is withdrawn from the supply roll by means of roll stand 15 mounting a pair of driven pull rolls which direct the web to the adhesive printer 16 which applies transverse stripes of adhesive to the undersurface of the advancing web in a manner which will be explained in greater detail hereinafter, as will the pertinent details of the various other operating components.

The printed web next passes around the heated drying drum 17 where the adhesive stripes are dried, the web being thereafter advanced in its path of travel by the roll stand 18 which also has a set of driven pull rolls, whereupon the web is led around guide roll 19 to the hollow mandrel assembly 20 where it is tubed. The aggregate or other filling material is introduced into the mandrel through the funnel-like hopper 21.

The formed tubing is withdrawn from the mandrel by the rotating turret 22 which mounts a plurality of tube sealing stations 23 at which the tubing is gathered and sealed at spaced intervals to form the sacks, the sacks being filled with aggregate discharged from the hollow mandrel as an incident of their formation. The filled and sealed sacks, upon being released from the turret, are discharged through discharge conduit 24.

With the foregoing general organization and operation of the apparatus in mind, its principal operating components will now be described in greater detail.

The Adhesive Printer

Figure 3:
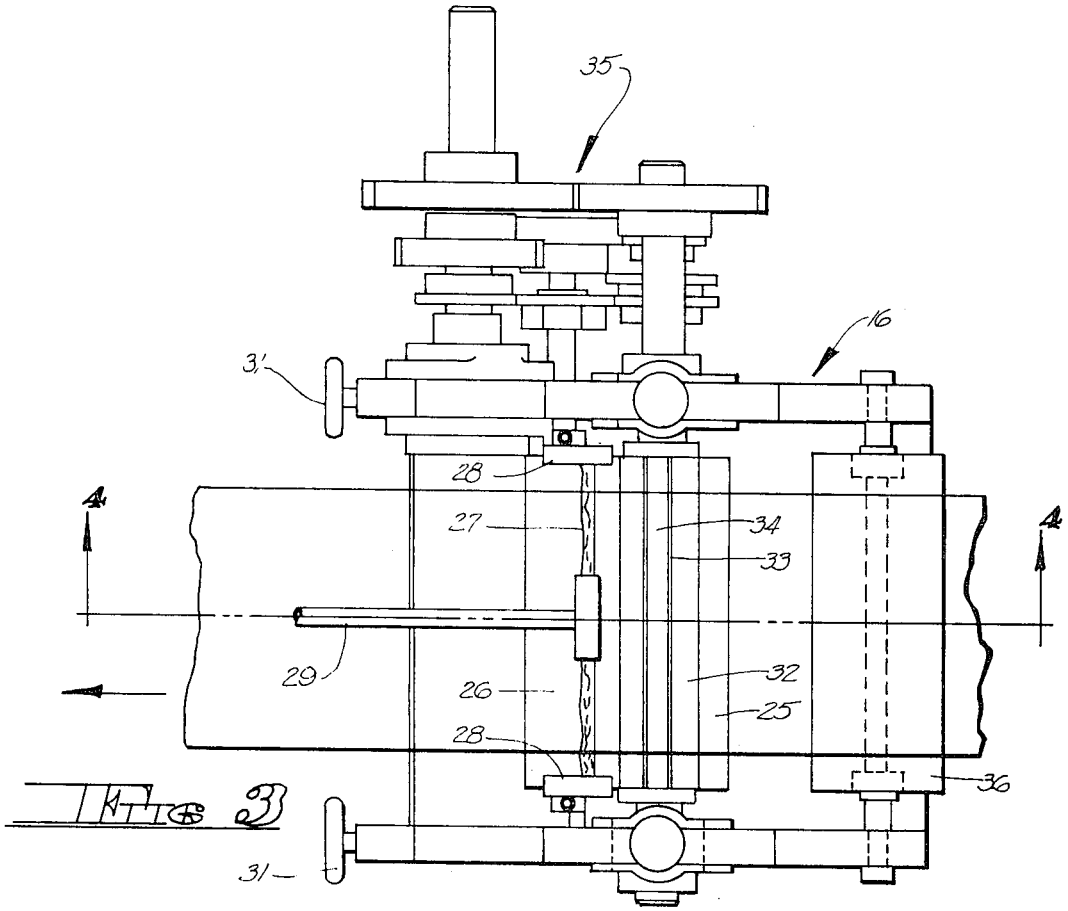
FIG. 3 is an enlarged plan view of the adhesive printing section of the apparatus.
Figure 4:
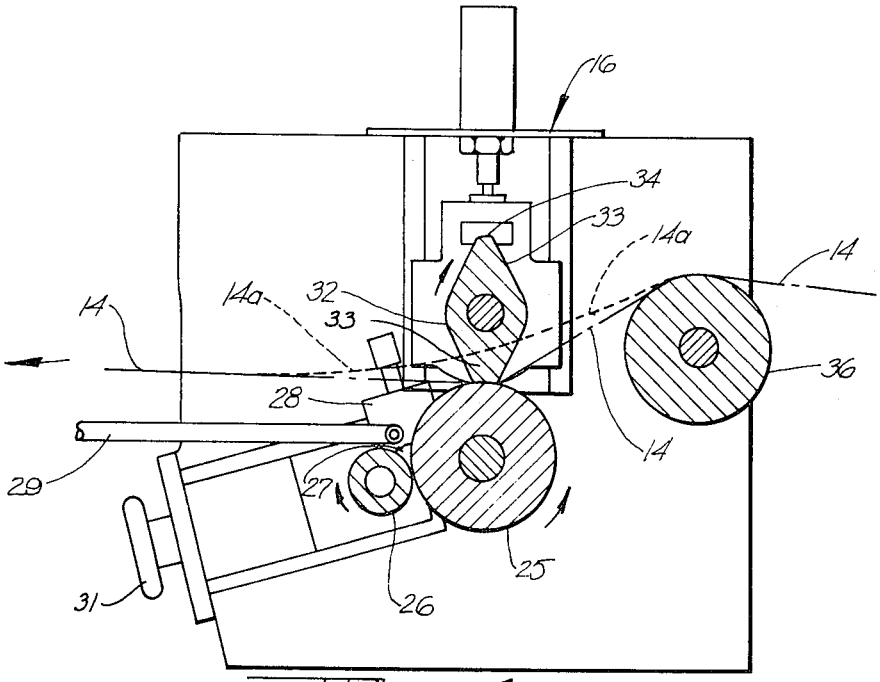
FIG. 4 is a vertical sectional view of the adhesive printing apparatus taken along the line 4—4 of FIG. 3.

Referring next to FIGS. 3 and 4, the adhesive printer 16 comprises an applicator roll 25 adapted to be coated with adhesive by the doctor roll 26, the rolls 25 and 26 coacting to form a pool of adhesive 27 which is maintained in the nip between the rolls by means of end dams 28, the adhesive being metered into the pool through supply conduit 29 through which the adhesive is pumped from a source of supply by pumping means 30 underlying the printing unit, such pumping means being illustrated at 30 in FIG. 1. With this arrangement, as the rolls 25 and 26 rotate in the direction of the arrows, a uniform coating of adhesive will be applied to the applicator roll 25, the thickness of the coating being controlled by the adjustment means 31 which varies the nip gap between applicator roll 25 and doctor roll 26.

The desired spaced apart transverse stripes of adhesive are printed on the undersurface of the web 14 by means of the dauber roll 32 having an opposing pair of fins 33 which act to press the undersurface of the web into contact with the underlying applicator roll 25 when the fins are in the position illustrated in FIG. 4. Thus, the width of the free end edges 34 of the fins determines the width of the transverse adhesive stripes since the only portions of the web 14 which contact the film of adhesive on the applicator roll 25 are those which span the end edges 34 of the fins. Accordingly, the width of the applied adhesive stripes may be varied by varying the width of the free end edges 34 of the fins. The speed of rotation of the dauber roll is such that its peripheral speed is matched to the lineal speed of the web and the peripheral speed of the applicator roll 25. The distance between adjacent stripes of adhesive is determined by the diameter of the dauber roll 32 and the number of fins 33 around its periphery. Suitable gear means 35 are provided to drive the dauber roll, as well as the applicator and doctor rolls at the desired speed.

The path of travel of the web 14 as it passes through the printer is governed by the entrance guide roller 36 which elevates the web relative to the pass line between the applicator roll 25 and the dauber roll 32. Unless contacted by one of the fins 33, the path of travel of the web will be along the dotted line 14*a* seen in FIG. 4, and it will be evident that the web will be spaced upwardly from the applicator roll 25 and hence free from contact with the adhesive on the applicator roll. It also will be evident that as the dauber roll 32 rotates the fins 33 will deflect the web downwardly into contact with the applicator roll and adhesive will be transferred to only those areas of the web which are brought into contact with the applicator roll.

The Adhesive Dryer

Figures 5, 6A, 6B, 6C, 6D:
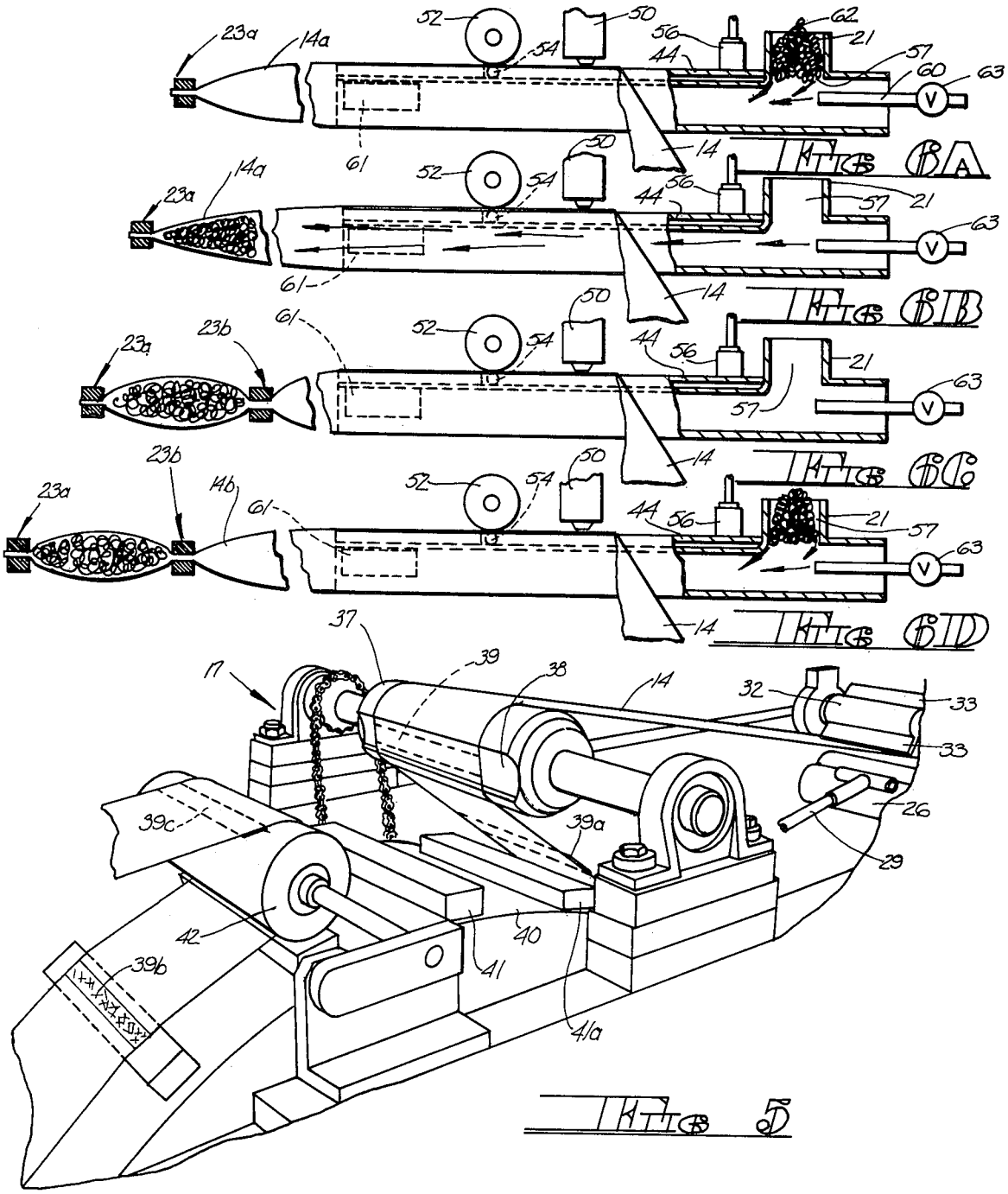
FIG. 5 is an enlarged fragmentary perspective view illustrating details of the adhesive dryer.
FIGS. 6A through 6D are fragmentary diagrammatic views illustrating, in successive stages, the manner in which the filling material is introduced into the hollow mandrel and propelled into the sacks being formed.

Upon leaving the adhesive printer 16, the web advances to the drying drum 17 which, as seen in FIG. 1, rotates in a clockwise direction in timed relation to the lineal speed of web travel. In order to insure adequate drying time, it is necessary for the web to be maintained in contact with the drum throughout the greater part of its periphery. In order to effect such contact, as well as reverse the surfaces of the web so that the applied stripes of adhesive will face away from the surface of the drum, a driven translation roll 37, best seen in FIG. 5, is utilized to reverse the direction of travel of the web. However, since it is the adhesive carrying undersurface of the web which contacts the translation roll, provision must be made to prevent the applied stripes of adhesive from contacting the translation roll. To this end, the translation roll is provided with one or more recessed areas 38 which are positioned to coincide with the adhesive stripes on the web, one such adhesive stripe being indicated in dotted lines at 39. As will be evident, the width of the recessed area 38 is greater than the width of adhesive stripe 39, and the depth of the recessed area will be sufficient to preclude contact of the adhesive with the bottom of the groove. As in the case of the other operating components of the apparatus, the translation roll will be driven in timed relation to the speed of travel of the web and the size of the roll and position of the groove or grooves 38 will be such that the grooves will coincide with the adhesive stripes.

Upon reversal of the direction of travel of the web 14, the web will be brought into contact with the drying drum, which is heated. The manner in which the drum is heated does not constitute a limitation on the invention, the essential consideration being to provide sufficient heat at least in the areas of the adhesive stripes to insure thorough drying of the adhesive by the time it leaves the drum. In the preferred embodiment of the invention, the cylindrical surface 40 of the drum is provided with a series of drying bars 41 positioned to coincide with the printed stripes of adhesive. Thus, as illustrated, the adhesive stripe 39*a* will coincide with the drying bar 41*a* as the web is juxtaposed to the surface of the bar. With this arrangement the heat may be localized since only the drying bars need to contact the web. Preferably the drying bars 41 will be coated with Teflon or other material having release properties since, if the web material is porous, as it is where tampons are being formed, some of the adhesive may strike through the web material to the surface in contact with the drying bars and hence adhere to the drying bars. The release coating on the bars insures separation of the web from the drum upon drying of the adhesive.

The web is withdrawn from the drum in close proximity to its point of initial conduct, preferably by being passed around a second translation roll 42 which again reverses the direction of the web. As the web on the drum approaches the translation roll 42, the adhesive stripes, such as the stripe 39*b*, will be outermost, but upon passage around the roll 42 the stripe will again be on the underside of the web, as illustrated at 39*c*. Since the adhesive stripes will be thoroughly dried while in contact with the drum, the adhesive stripes will not adhere to the roll 42 and consequently it may comprise a plain guide or idler roll, particularly since the web will be positively withdrawn from the drum by the action of the driven pull rolls in the roll stand 18 which advances the web from the drying drum toward the tube forming mandrel.

The Tubing Mandrel

Figures 7, 8:
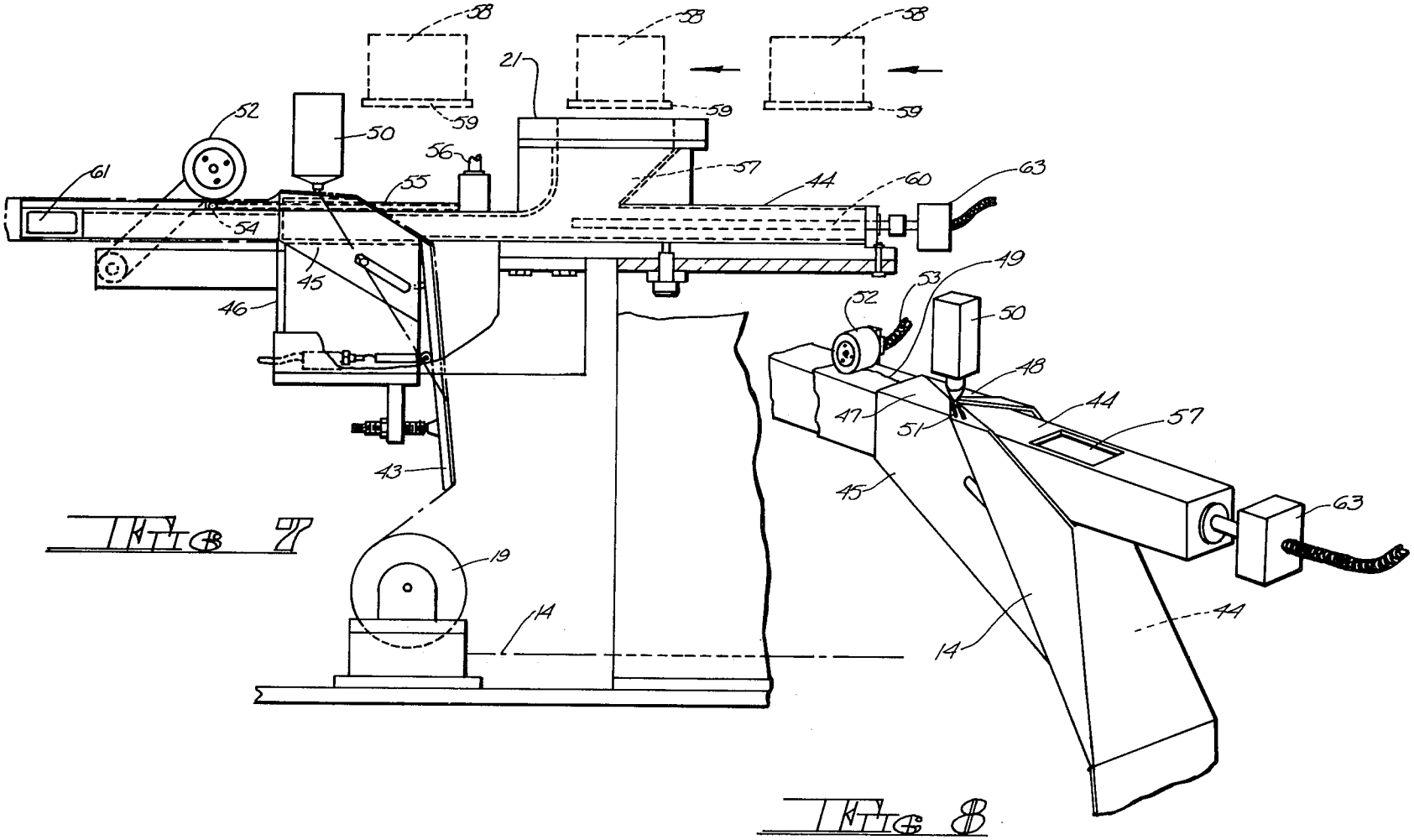
FIG. 7 is an enlarged fragmentary side elevational view with parts broken away of the hollow mandrel and related components.
FIG. 8 is an enlarged fragmentary perspective view with non-essential parts removed illustrating the manner in which the web is tubed around the mandrel.

Upon passage through the roll stand 18 the web is led around guide roll 19 and, as best seen in FIG. 7, over guide plate 43 which guides the web between the hollow mandrel 44 and the forming shoe 45 which is adjustably mounted on support 46 and acts to fold the web around the mandrel. The technique for folding the web around the mandrel is known to the art; the details can be found in the commonly owned U.S. Pat. No. 3,445,897, dated May 27, 1969, and entitled "Method Of Making Sanitary Napkins And The Like". Essentially, and as possibly best seen in FIG. 8, the hollow mandrel 44 is of rectangular configuration and is surrounded by the forming shoe 45 which acts as a sweep to fold the web about the mandrel, the forming shoe having overlapping triangular portions 47 and 48 between which the opposite side edges of the web are folded and juxtaposed in overlapping relation to form a longitudinal seam 49. An adhesive applicator 50, preferably utilizing a hot melt adhesive, applies one or more narrow, longitudinally extending filaments of adhesive 51 to a marginal edge of the web immediately prior to the overlapping of the web edges, the adhesive filaments thus being interposed between the overlapping edges of the web to form the longitudinal seam.

As the tubed web passes beyond the trailing end of the forming shoe 45, the longitudinal seam is contacted by an external pressure roll 52 which is preferably chilled, as by means of cool air introduced into the roll through a conduit 53. Referring again to FIG. 7, a small sealing roll 54 is mounted on the mandrel immediately beneath the pressure roll 52 so that the longitudinal seam will be compressed and sealed between the two rolls. To insure rapid setting of the applied adhesive, the small sealing roll 54 is also chilled, the roll 54 lying at the end of a shallow duct 55 extending along the upper surface of the mandrel into which cool air is introduced through inlet 56.

In addition to its tube forming function, the hollow mandrel 44 also serves as the means for introducing measured increments of aggregate or like contents into the sacks being formed. To this end, the mandrel is provided with the funnel-like hopper 21 into which measured increments of material are sequentially deposited from a source of supply, the mandrel having an opening 57 in communication with the hopper. While the manner in which the measured increments of material are deposited in the funnel-like hopper does not constitute a limitation on the invention, a series of continuously moving measuring cups have been diagrammatically indicated at 58, such cups having displaceable bottoms 59 adapted to open as the cups pass over the funnel-like hopper 21. As the filling material is deposited in the funnel-like hopper, the charge is subjected to a blast of air from air jet 60 the orifice of which underlies the opening 57, the jet of air acting to propel the material through the hollow mandrel and into the tubed web, the mandrel having a discharge orifice 61 at its trailing end which is diagonally disposed relative to the longitudinal axis of the mandrel.

Referring next to FIG. 6, which sequentially illustrates the successive stages in the filling operation, as the filling material 62 is deposited in the hopper 21, as shown in FIG. 6A, a valve 63 controlling the flow of air under pressure to air jet 60 is automatically opened and a stream of air is projected lengthwise of the mandrel in the direction of the discharge orifice 61. The jet of air will create a negative pressure in the funnel-like hopper 21 and hence will act, in part, to suck the filling material into the mandrel through opening 57 and, at the same time, the material as it enters the mandrel will be picked-up by the air stream propelled toward the discharge orifice 61. This occurs as the leading end of the web 14 is shaped into a sack-forming tube and its leading end closure is formed and sealed by sealing station 23*a*. Thus, the entire charge of filling material is blown into the sack-forming tube 14*a*, as shown in FIG. 6B, whereupon the valve 63 is closed to shut off the supply of air to jet 60, as shown in FIG. 6C. Concurrently, the trailing end of the sack being formed is closed by the next succeeding sealing station 33*b*. As the trailing end seal is completed, another increment of filling material is being deposited in the funnel-like opening and the valve 63 again opened, as shown in FIG. 6D, thereby initiating the filling of the next succeeding sack being formed, indicated at 14*b*.

The Sack Forming And Sealing Turret

Figure 9:
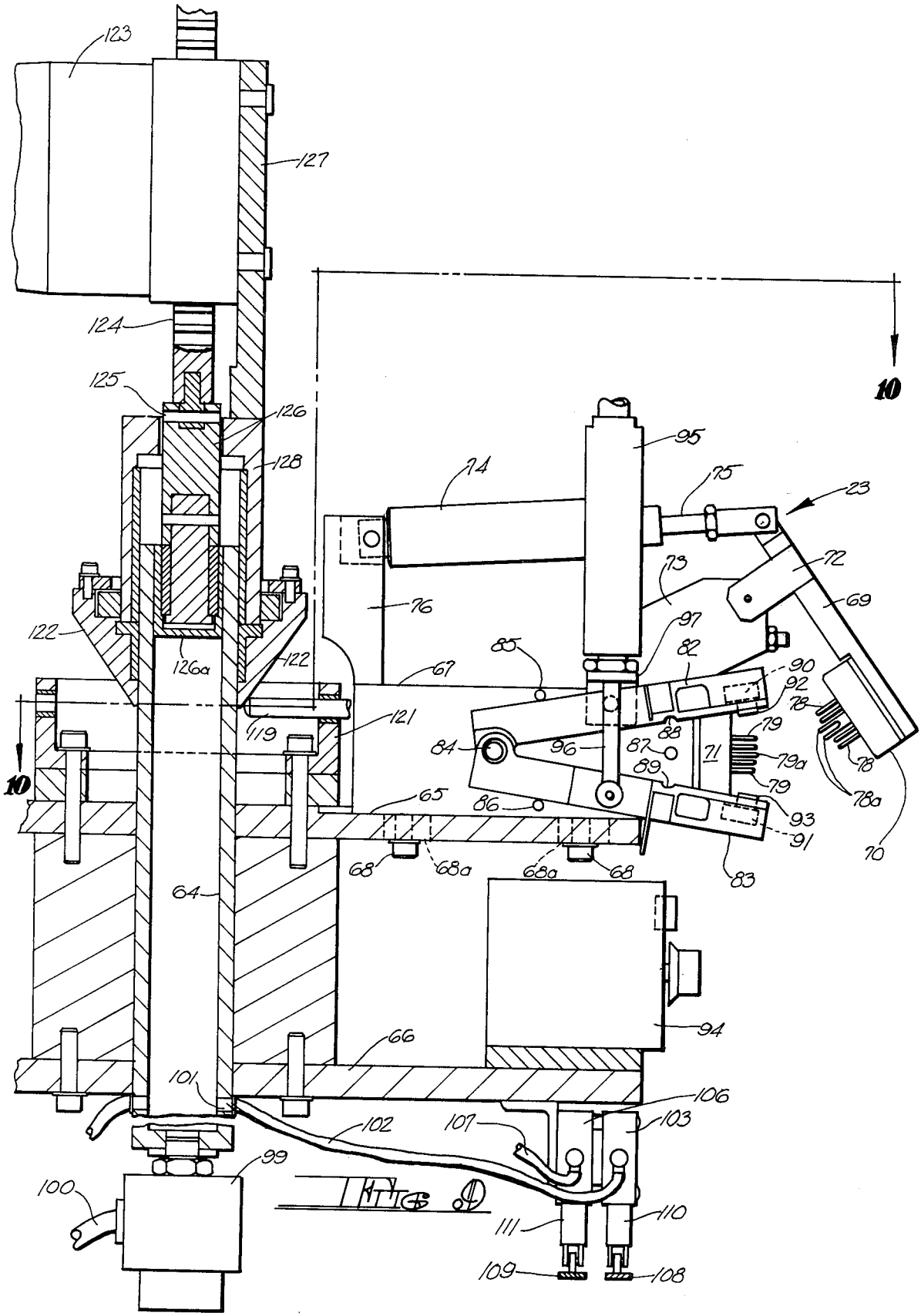
FIG. 9 is an enlarged fragmentary vertical sectional view through the center of the turret, with non-essential parts removed, illustrating the pleating and clamping jaws in the open position.

Referring again to FIG. 1, the rotating turret 22 which carries the tube sealing stations 23 is mounted on a vertically disposed tubular drive shaft 64 journaled on the frame 10 and driven from the common prime mover 11. As best seen in FIG. 9, toward its upper end, the drive shaft 64 mounts an upper platform 65 and a lower platform 66 each of which is fixed to the drive shaft 64 for rotation therewith. The upper platform 65 carries a series of radially disposed mounting blocks 67 on which the various operating components for each station are mounted. The blocks 67 are radially adjustable on platform 65 by means of the adjustment bolts 68 which extend through elongated aligned slots in the platform, such slots being indicated at 68*a*.

The first of the operating components comprises a movable pleating jaw 69 having a pleating head 70 adapted to coact with a mating pleating head 71 fixedly secured to the block 67. The movable jaw 69 is pivotally connected by a yoke 72 to an arm 73 fixed to mounting block 67, pivoting movement of the jaw being effected by means of cylinder 74 having a piston rod 75 the distal end of which is pivotally connected to the movable jaw 69. The opposite end of cylinder 74 is pivotally connected to a supporting arm 76 fixed to mounting block 67. When the piston rod 75 is in the retracted position illustrated in FIG. 9, the jaw 69 will be open; but when the piston rod is extended, the jaw will move to the position illustrated in FIG. 12 in which the jaw has closed to juxtapose the pleating heads 70 and 71. The cylinder 74 may be either pneumatic or hydraulic, and will be provided with fluid ports 77 and 77*a* at its opposite ends to selectively drive the piston rod 75 in opposite directions.

Figure 12:
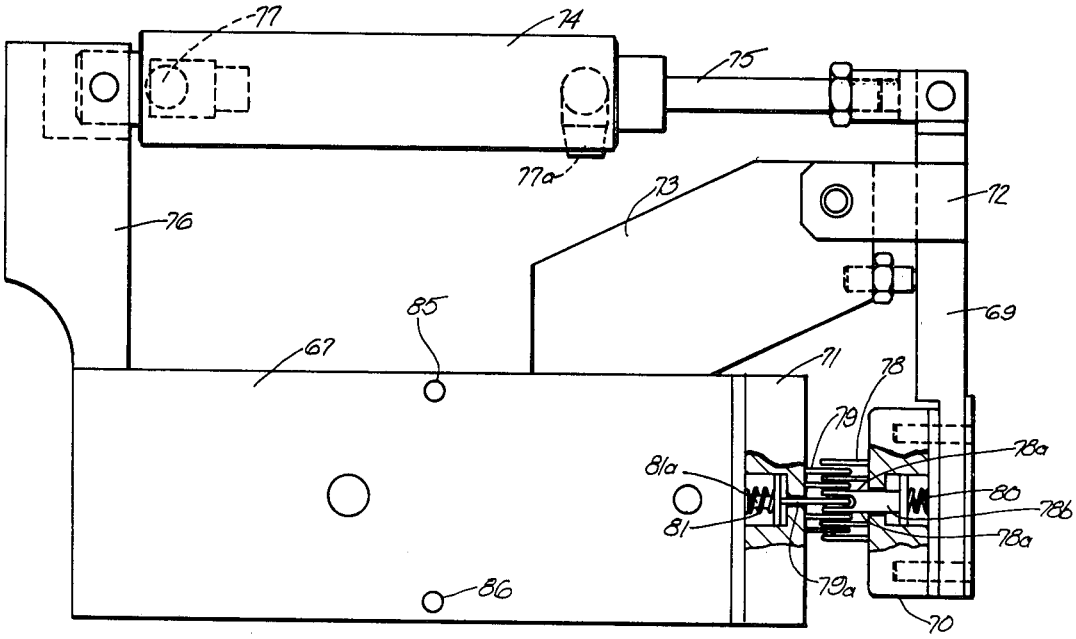
FIG. 12 is a fragmentary side elevational view with non-essential parts removed illustrating the pleating jaws in the closed position.
Figure 13A:
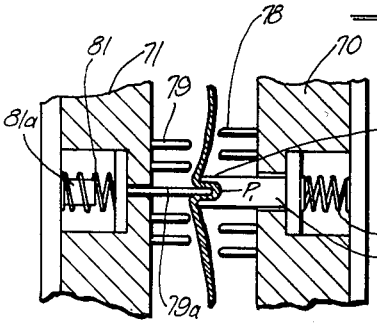
FIGS. 13A through 13C are enlarged fragmentary side elevational views illustrating the progressive pleating of the tubing as the pleating jaws move to the closed position.
Figure 13B:
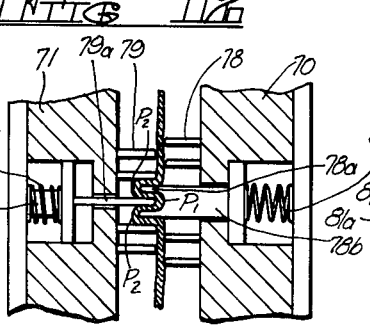
Figure 13C:
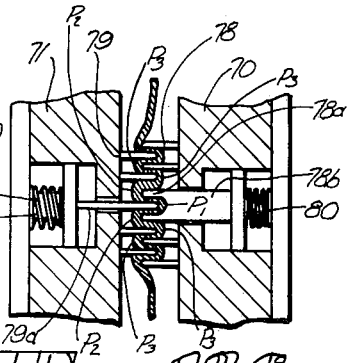

The pleating heads 70 and 71 are provided with sets of interdigitating gathering or pleating fingers 78 and 79 which, as the jaws close, gather and fold the tubing therebetween. The pleating fingers are preferably of blade-like configuration, as seen in FIG. 12, being of a width sufficient to gather and fold the tubing without puncturing it. However, in order to prevent possible tearing or puncturing of the tubing as the pleats are formed, it is preferred that the centermost fingers be somewhat longer than the outlying fingers. Thus, in the embodiment illustrated, the centermost pair of fingers 78*a* of pleating head 70 are longer than the other fingers 78; and similarly the centermost finger 79*a* of pleating head 71 is longer than the other fingers 79. The pair of fingers 78*a* are mounted on a common support 78*b* and are axially movable relative to the pleating head 70, being biased to the extended position by a spring 80. Similarly, finger 79*a* is mounted for axial movement relative to pleating head 71 and is biased to its extended position by spring 81 which surrounds a stop 81*a*. It is preferred that the spring 80 be substantially stronger than the spring 81. As a result, when pleating is initiated, the finger 79*a* will first pass between the pair of fingers 78*a* until it contacts the base 78*b*, as seen in FIG. 13A, thereby forming a centermost fold indicated at $P_1$. As the pleating head 70 continues to move toward head 71, the finger 79*a* will be retracted until it seats against stop 81*a* due to the fact that spring 80 is stronger than spring 81, thereby forming the additional folds $P_2$ lying to each side of fold $P_1$, as seen in FIG. 13B. Once seated against stop 81*a*, the finger 79*a* will act through common support 78*b* to urge the pair of fingers 78*a* rearwardly against the bias of spring 80 until the parts have reached the position illustrated in FIG. 13C in which the pair of fingers 78*a* is fully retracted and the outlying fingers in the sets 78 and 79 are in interdigitating relation to form additional folds $P_3$. Thus, the pleats are progressively formed working outwardly from the center of the tubing, such progressive pleating effectively relieving excessive tension on the tubing which might otherwise cause it to rupture.

Figure 14:
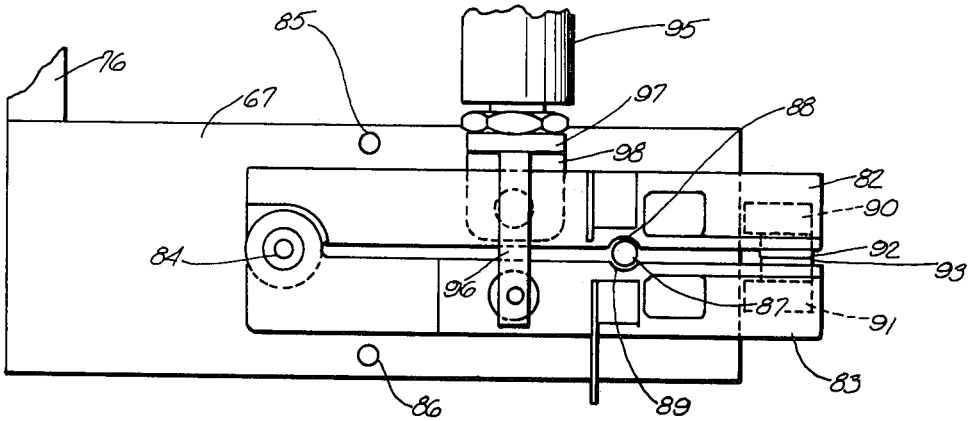
FIG. 14 is a fragmentary side elevation with non-essential parts removed illustrating the sealing jaws in the closed position.
Figure 15:
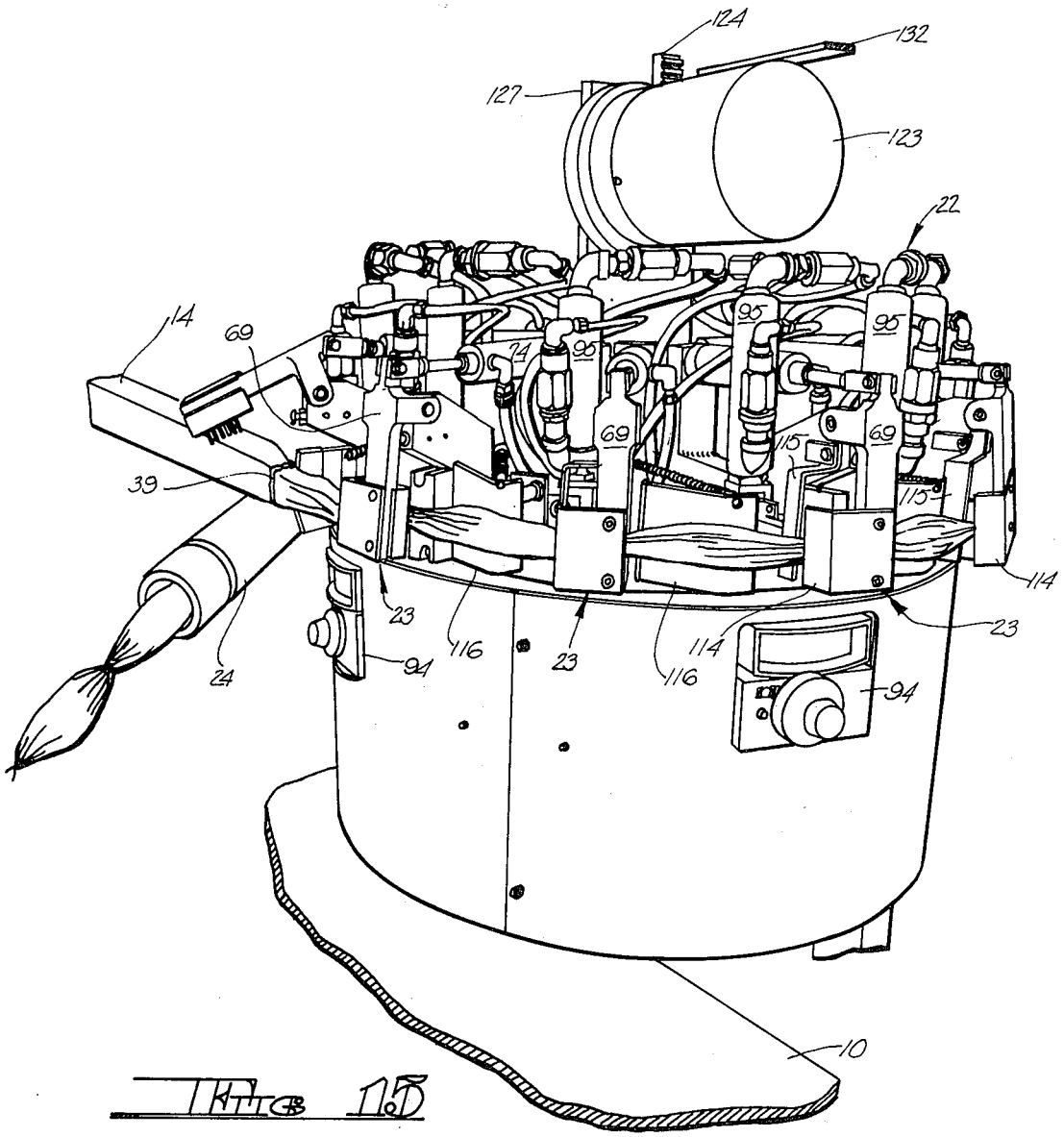
FIG. 15 is a perspective view of the sack-forming turret taken from the side of the turret on which the formed tubing is initially engaged by the pleating and sealing stations.
Figure 16:
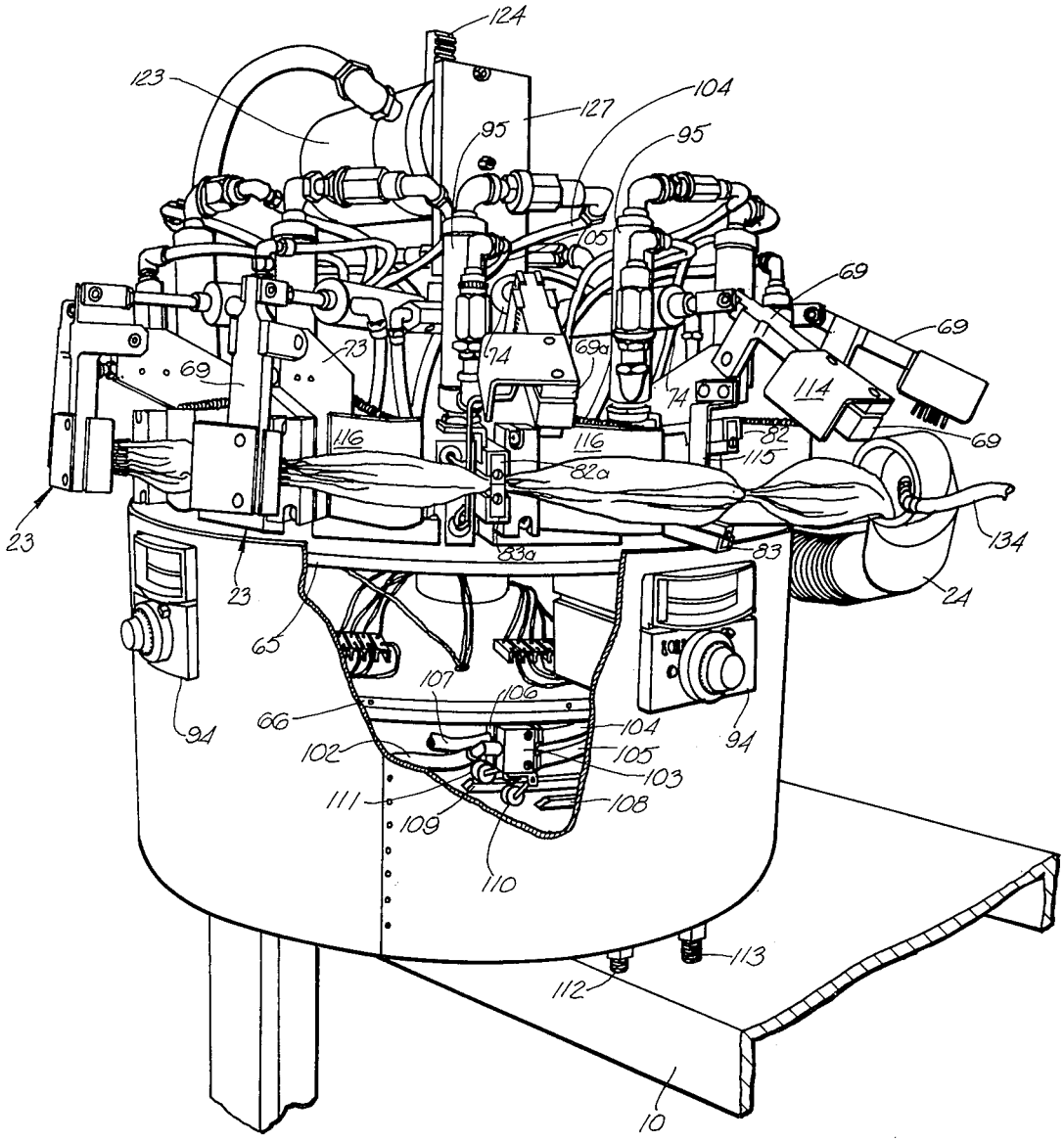
FIG. 16 is a perspective view, with parts broken away, taken from the side of the turret opposite that illustrated in FIG. 15, showing the filled and sealed sacks as they are discharged.

Each of the mounting blocks 67 also carries a pair of sealing jaws 82 and 83, seen in FIGS. 9 and 14, which lie immediately to one side of the pleating head 71, the sealing jaws being in vertical alignment and pivotally connected at their rearmost ends to a common pivot pin 84. The open position of the sealing jaws is illustrated in FIG. 9, the extent of their opening movement being limited by the stops 85 and 86 which project laterally from the mounting block 67. A centering pin 87 also projects laterally from the block 67 to align the jaws relative to the pleated tubing when the jaws are closed, the jaws having grooves 88 and 89, respectively, adapted to be positioned, when closed, by the centering pin 87. The closed position of the jaws is illustrated in FIG. 14. The jaws enclose heating elements, indicated at 90 and 91, which act to heat the sealing surfaces 92 and 93 of the jaws to the temperature required to reactivate the transverse stripes of adhesive 39 on the tubing, which stripes will be aligned with the sealing jaws. It will be understood that the heating elements 90 and 91 may be provided with temperature sensing means to indicate the temperature of the sealing surfaces. Preferably, a series of temperature indicating and control devices 94 will be mounted on the lower platform 66, as seen in FIGS. 9, 15 and 16, each such control device serving to indicate and control the temperature of a plurality of sealing jaw sets. In the embodiment illustrated, which has twelve pleating and sealing stations, each temperature indicating and control device 94 serves three adjoining stations.

Figure 11:
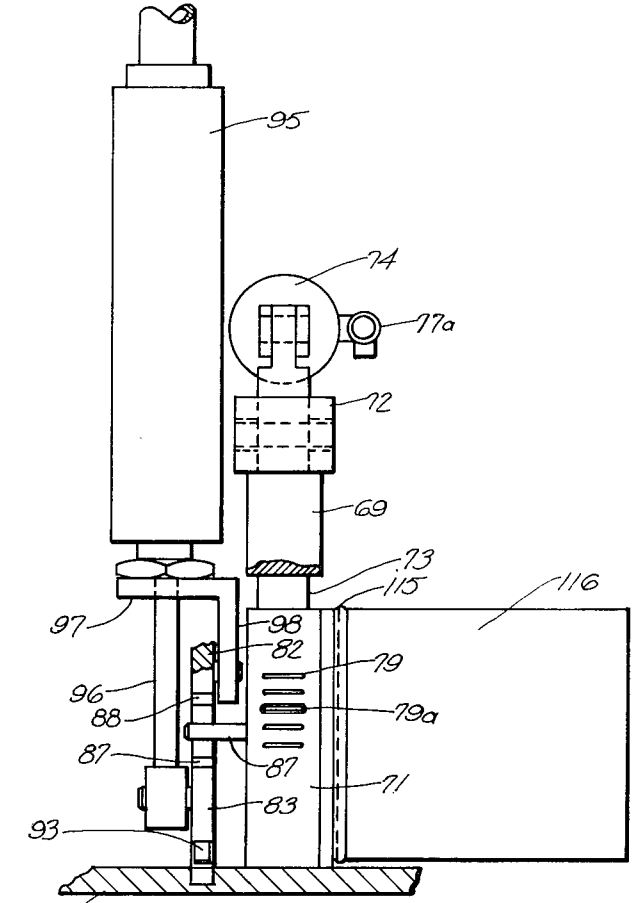
FIG. 11 is a fragmentary end elevational view, with non-essential parts broken away or removed, taken from the right side of the middle operating station seen in FIG. 10.

Each set of sealing jaws 82, 83 is opened and closed by means of a cylinder 95 having a piston rod 96 the free end of which is pivotally connected to the lower jaw 83. The cylinder 95 is secured at its lowermost end to the flange 97 of a bracket 98 which is pivotally connected to the upper sealing jaw 82, as possibly best seen in FIG. 11. The jaws 82 and 83 will be opened when the piston rod 96 is extended, as by the introduction of air under pressure into the upper end of cylinder 95. When air under pressure is introduced into the lower end of cylinder 95 to retract the piston rod 96, relative movement will be effected between the cylinder 95 and the piston rod 96; that is, the piston rod 96 will draw the lower jaw 83 upwardly until it seats against centering pin 87. Continued relative movement between the cylinder and its piston rod results in the downward movement of cylinder 95, which is mounted on the upper jaw 82, and hence the upper jaw is also caused to be positioned and centered by the centering pin 87. As a practical matter, it has been found that both jaws tend to close substantially simultaneously; that is, the cylinder 95 will tend to move downwardly as the piston rod 96 moves upwardly.

Air under pressure for actuating both the pleating jaw 69 and the sealing jaws 82, 83 is supplied to the hollow interior of drive shaft 64 through a suitable rotary joint 99 supplied with air under pressure from a source of supply (not shown) through inlet conduit 100. The drive shaft 64 has a series of radially disposed outlet ports, one of which is indicated at 101, each such port being connected through a conduit 102 to a cam actuated valve 103 which, as seen in FIG. 16, has outlet conduits 104 and 105. These outlet conduits are respectively connected to the opposite ends of the cylinder 95 which controls the sealing jaws at the overlying station 23. It will be understood that the cylinder 95 at each of the stations 23 will be controlled by a cam actuated valve 103. Similarly, and again with reference to FIG. 9, a cam actuated valve 106, supplied with air under pressure from drive shaft 64 through a conduit 107, will supply air under pressure to the opposite ends of each of the cylinders 74 which controls the movement of pleating jaw 69. Thus, the movement of each set of sealing jaws 82, 83 is controlled by a valve 103 and each movable clamping jaw 69 is controlled by a valve 106.

The valves 103 and 106 are actuated by means of cam tracks 108 and 109, respectively, which move the valve stems 110 and 111 from one position to the other. The valves 103 and 106 are mounted on the undersurface of lower platform 66 and hence rotate with the turret, whereas the cam tracks 108 and 109 are fixedly mounted on the frame 10, as by means of the supporting posts 112 and 113 seen in FIG. 16. In the position of the valves illustrated in FIG. 16, the cam follower on valve stem 111, which controls valve 106, is in contact with the cam track 109 and, when in this position, air under pressure will be introduced into the rod end of cylinder 74 controlling the overlying movable pleating jaw, indicated at 69*a*, and the jaw is in the open position. The cam follower on valve stem 110 of valve 103 has not yet contacted cam track 108 and consequently the overlying pair of sealing jaws, indicated at 82*a* and 83*a*, remain closed, i.e., air under pressure is being supplied to the rod end of the cylinder 95 and its piston rod 96 is in the retracted position. When the position of valve stem 110 is shifted by contact with the cam track 108, the lower end of cylinder 95 will be vented and air under pressure will be introduced into its upper end, thereby extending the piston rod 96 and hence opening the sealing jaws, thereby freeing the formed and sealed sack for discharge through the discharge conduit 24.

Figure 10:
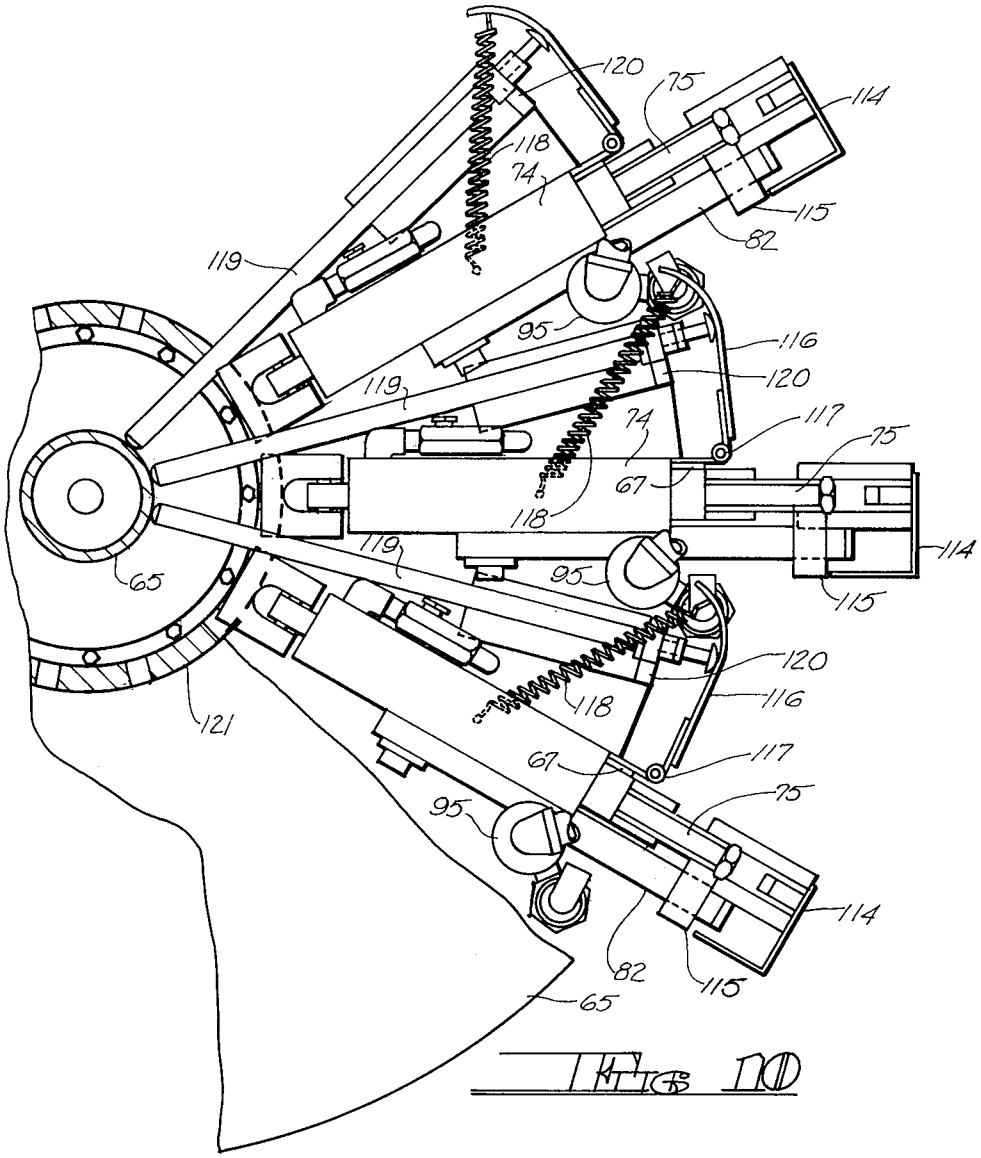
FIG. 10 is a horizontal sectional view taken along the irregular line 10—10 of FIG. 9 illustrating a series of adjacent operating stations on the turret.

As best seen in FIGS. 10 and 15, each of the movable pleating jaws 69 also mounts a tube deflecting bar 114 which moves with the jaw, and a coacting tube deflecting bar 115 is fixedly secured to each mounting block 67. The deflecting bars 114 and 115 are positioned to engage opposite sides of the tubing immediately beyond the sets of sealing jaws 82 and 83, and as the pleating jaw 69 closes (which occurs prior to the closing of the sealing jaws), the deflecting bars compact or narrow the tubing so that the area of the pleated tubing contacted by the sealing jaws will be quite narrow and hence form a narrow end seal. In effect, as the pleating jaws gather and fold the tubing into a series of horizontally disposed pleats, the vertically disposed deflecting bars gather and contact the tubing inwardly from the opposite sides of the pleats and hence minimize the width of the pleats in the area of the tubing contacted by the sealing jaws.

As previously indicated, the mounting blocks 67 which mount both the pleaters and the sealing jaws are readily adjustable by means of adjustment bolts 68 to vary the pitch distance between adjacent stations so that the transverse adhesive stripes on the tubing will register with the sealing jaws. There is, however, a difference in the distance between the adjoining transverse adhesive stripes depending upon whether there is a charge of filling material in the tubing. That is, when the leading end of the tubing is initially engaged by one of the sealing stations 23 at start-up and the tubing is being pulled from the mandrel by the turret as it rotates, the tubing will be collapsed and fully extended; however, when the charges of filling material are introduced, the tubing is expanded radially outwardly, such expansion effectively foreshortening the distance between adjacent transverse adhesive stripes. Accordingly, the mounting blocks will be adjusted to accomodate the filled tubing and insure registry of the transverse adhesive stripes with the sealing jaws during normal machine operation, and mechanism is provided to effectively adjust the pitch distance between sealing stations during start-up when the distance between adjoining transverse adhesive stripes is greater. In this connection, it may take several minutes or more at start-up to be certain that all components of the apparatus are functioning properly before actual filling of the sacks is initiated, but during this period accurate registry of the transverse adhesive stripes must be maintained, otherwise they will be out of registry when filling commences.

Registry during start-up is accomplished by means of the adjustable plates or shoes 116 which, as seen in FIG. 15, lie between adjacent stations 23. The shoes press against the tubing as it initially enters the turret and act to deflect or bow the unfilled tubing outwardly to the extent necessary to bring the transverse adhesive stripes 39 into registry with the sealing jaws. As best seen in FIG. 10, each of the plates has a hinge 117 extending along its trailing side edge, which hinge is also secured to the adjoining mounting block 67. Preferably, the plates are of curved configuration and are biased inwardly by spring members 118. Each of the plates is contacted on its inner surface by an axially movable push rod 119 slidably journaled adjacent its outermost end in a mounting ring 120. The push rods 119 are radially disposed and toward their inner ends are slidably journaled in a mounting ring 121 which surrounds the drive shaft 64 and is secured to the upper rotating platform 65, as possibly best seen in FIG. 9.

Push rods 119 are adapted to be displaced outwardly by the conical hub 122 which surrounds and is slidably mounted on the upper end of drive shaft 64. As will be evident, downward movement of the conical hub 122 from the position illustrated in FIG. 9 will effectively cam the push rods 119 outwardly, and in so moving, the push rods will displace the plates 116 outwardly by a corresponding amount. Accordingly, by adjusting the vertical position of the conical hub relative to the push rods 119, the spacing plates can be moved outwardly during start-up to effectively increase the pitch distance between the sealing jaws at adjacent stations and hence bring the transverse glue stripes 39 into registry for sealing when the tubing is empty. When filling is initiated, the spacing plates will be retracted to free them from contact with the tubing.

Vertical adjustment of the conical hub is effected by means of a servomotor 123 having a pinion (not shown) which engages a rack 124 the lowermost end of which is pinned at 125 to a plug which is received in and rotatably secured to cup member **126*a* which is fixed within the upper end of tubular drive shaft 64. The servomotor 123 is mounted on a support plate 127 the lower end of which is fixedly secured to a cap member 128 which surrounds and is slidably journaled relative to the drive shaft 64, the cap member being fixedly secured to the conical hub 122**.

In operation, when the servomotor 123 is activated, it will climb the rack 124, the servomotor as it moves upwardly acting through support plate 127 and cap member 128 to draw the conical hub 122 upwardly. Conversely, as the motor climbs downwardly along the stationary rack, the conical hub will be moved downwardly. Thus, by adjusting the vertical position of the conical hub 122, the operator can increase or decrease the effective pitch distance between the sealing jaws at adjacent operating stations and hence bring the adhesive stripes 39 defining the end seals of the sacks being formed into registry with the sealing jaws. As seen in FIG. 1, means are provided to stabilize the servomotor 123; the stabilizing means preferably comprising a guide bracket 129 secured at one end to the servomotor and slidably connected at its opposite end for vertical movement relative to a guide post 130.

Means are also provided to adjust the phase of the turret relative to the transverse adhesive stripes. At start-up it may be necessary to rotate the turret in either direction to bring one of the sealing stations into proper alignment with the leading end of the tubing to effect initial registry of the leading transverse adhesive stripe with the sealing jaws at such station. To this end, and as illustrated in FIG. 1, the gear train between the prime mover 11 and turret drive shaft 64 includes a phase adjusting transmission 131 by means of which the turret may be independently rotated in either direction to bring the sealing stations into initial registry with the tubing.

As previously described in conjunction with FIG. 6, the air jet 60 which propels the charges of filling material from the hollow mandrel into the sacks being formed is activated by a valve 63. The movement of this valve, which may be solenoid actuated, is preferably controlled by the rotation of the turret since its operation must be timed with the formation of the end seals. As also illustrated in FIG. 1, the desired timing may be achieved by mounting a timing disc 132 on the lower portion of drive shaft 64, the timing disc coacting with a pulse generator 133 which is of known construction and which, as will be understood by the worker in the art, acts to sequentially open and close valve 63 through a solenoid or other servomechanism controlling the opening and closing movement of the valve.

As the formed and filled sacks are released from the turret upon the opening of the sealing jaws, they are in continuous series and are introduced into the discharge conduit 24 which conveys the sacks away from the turret for delivery to a collection station or to apparatus for performing additional manufacturing operations, such as the attachment of withdrawal strings. In order to prevent undue strain on the newly formed end seals until the adhesive has thoroughly set, it is preferred to continuously introduce air under pressure into the mouth of the discharge conduit 24, as by means of the nozzle 134, seen in FIG. 16, the air stream so formed serving the dual functions of conveying the sacks and acting as a cooling medium to insure rapid setting of the adhesive forming the end seals.

As should now be evident, the present invention provides apparatus and procedures for forming and filling tampon sacks in a continuous operation. In its apparatus aspects, the invention contemplates the various components by means of which the sacks are formed, filled and sealed, and in its method aspects the invention contemplates the techniques by means of which the tubing is formed, gathered and sealed, and the contents introduced into the sacks as they are formed.

While various modifications of the invention have been set forth, additional modifications and variations will undoubtedly occur to the worker in the art upon reading this specification, and it is not intended that the scope of the invention be limited other than in the manner set forth in the claims which follow. By way of example, while in the preferred embodiment of the invention the longitudinal seam in the tubing is formed by the application of one or more narrow filaments of adhesive to a marginal edge of web as an incident of its tubing, such seam could be formed in other ways, as by the application of such adhesive at the adhesive printer and its subsequent drying on the drying drum, a suitable heating element being provided on the mandrel to reactivate the adhesive upon the overlapping of the marginal edges of the web as it is tubed around the mandrel. In the event the web material itself is inherently heat sealable, the adhesive applying and drying portions of the apparatus may be bypassed and a heated sealing element provided at the mandrel positioned to contact and seal the overlapped side edges of the tubing being formed.

The embodiments of the invention in which an exclusive property or privilege is claimed are defined as follows:

1. In apparatus for forming and filling flexible tubing to form sealed packages, a rotatable turret, drive means for rotating said turret;

a plurality of pleating and sealing stations located at substantially equally spaced intervals about the periphery of said turret, each station including pleating means movable from an open to a closed position, and sealing means also movable from an open to a closed position; and open-close means for sequentially closing and opening said pleating means and said sealing means during each cycle of rotation of said turret, whereby a continuous length of flexible tubing may be fed to the turret for engagement at spaced intervals by successive pleating and sealing stations and the tubing gathered and sealed at predetermined spaced intervals to form individual packages.

2. The apparatus claimed in claim 1 including means operative to introduce contents into the tubing as the tubing is being formed into individual packages.

3. The apparatus claimed in claim 2 wherein the means for introducing contents into the tubing comprises a hollow mandrel about which the tubing passes as it is fed to said turret, means for introducing increments of filling material into the hollow interior of the mandrel, and means for propelling the increments of filling material from the mandrel into the tubing in timed relation to the closing movement of said pleating and sealing means.

4. The apparatus claimed in claim 3 including a forming shoe surrounding said mandrel, means for advancing a web of flexible tube forming material to said mandrel for passage between said mandrel and said forming shoe, said forming shoe being configured to fold the web about the mandrel with its opposite marginal side edges overlapped for forming the web into tubing, and means associated with said mandrel and forming shoe for sealing together the overlapped marginal side edges of the web to form a longitudinal seam.

5. The apparatus claimed in claim 4 including adhesive printing means ahead of said mandrel for printing transverse stripes of adhesive on the advancing web at spaced apart intervals corresponding to the distance between adjoining pleating and sealing stations on said turret.

6. The apparatus claimed in claim 5 including adhesive drying means positioned between said adhesive printing means and said mandrel for drying the transverse stripes of adhesive prior to the delivery of the web to said mandrel.

7. The apparatus claimed in claim 6 wherein the means for advancing the web of tube forming material to the mandrel includes driven means for withdrawing the web from a source of supply located ahead of said adhesive printing means, and means for driving said driven means in timed relation to the rotation of said turret.

8. The apparatus claimed in claim 7 wherein said adhesive printing means includes an applicator roll for applying the transverse stripes of adhesive to the web, and means for rotating said roll in time relation to the movement of the web.

9. The apparatus claimed in claim 8 wherein said adhesive drying means comprises a rotatable drying drum around which the web passes, and means for rotating said drying drum in timed relation to the movement of the web.

10. The apparatus claimed in claim 1 wherein said pleating means comprises an opposing pair of pleating heads each mounting a plurality of pleating fingers, lying in closely spaced apart relation, the fingers on the opposing heads lying in interdigitating relation when said pleating means is in closed position.

11. The apparatus claimed in claim 10 wherein some at least of said fingers are axially movable relative to said heads from an extended to a retracted position, and spring means biasing said movable fingers to their extended position.

12. The apparatus claimed in claim 10 wherein one of the pleating heads in each pair is fixedly mounted on the turret, and wherein the other pleating head of each pair is secured to a pivotally mounted pleating jaw operatively connected to said open-close means.

13. The apparatus claimed in claim 12 wherein the open-close means for each pleating jaw comprises a fluid actuated cylinder having a piston rod operatively connected to said pleating jaw, valve means including a movable valve stem for selectively introducing fluid under pressure into the opposite ends of said cylinder to extend and retract said piston rod, said valve means being mounted on said turret for rotation therewith, a cam follower on said valve stem, and a cam track fixedly mounted relative to said turret and positioned to be contacted by said cam follower during a portion of the rotative cycle of said turret, whereby to open and close said pleating jaw in accordance with the position of said valve stem relative to said cam track.

14. The apparatus claimed in claim 1 wherein the sealing means at each station comprises a set of sealing jaws having sealing surfaces, said sealing jaws being pivotally mounted relative to each other for opening and closing movement, means for heating the sealing surfaces of said jaws, and means for controlling the temperature of said sealing surfaces.

15. The apparatus claimed in claim 14 wherein the open-close means for each set of sealing jaws comprises a second fluid actuated cylinder having a piston rod, said cylinder being operative connected to one of said sealing jaws for movement therewith, said piston rod being operatively connected to the other of said sealing jaws, second valve means including a movable valve stem for selectively introducing fluid under pressure into opposite ends of said second cylinder to extend and retract said piston rod relative to said cylinder, said second valve means being mounted on said turret for rotation therewith, a cam follower on said last named valve stem, and a second cam track fixedly mounted relative to said turret and positioned to be contacted by the cam follower of said second valve means during a portion of the rotative cycle of said turret, whereby to open and close said sealing jaws in accordance with the position of the valve stem of said second valve means relative to said second cam track.

16. The apparatus claimed in claim 1 including adjustable means between each adjacent pleating and sealing station positioned to contact the portions of tubing extending between adjacent stations, said adjustable means being movable outwardly to effectively increase the length of tubing extending between the adjacent stations, and movable inwardly to effectively decrease the length of the tubing extending between said adjacent station.

17. The apparatus claimed in claim 16 wherein said adjustable means between each adjacent pleating station comprises a curved plate hingedly connected along one side edge to said turret, spring means biasing each plate inwardly, an axially movable push rod for each plate, each push rod having its outermost end positioned to contact the inner surface of the plate with which it is associated, and cam means positioned to contact the innermost ends of said push rods to move them relative to said plates.

18. The apparatus claimed in claim 17 including a vertically disposed drive shaft mounting said turret for rotation therewith, the cam means for moving said push rods comprising a conical hub slidably mounted on said drive shaft, and means for raising and lowering said conical hub relative to said push rods.

19. The apparatus claimed in claim 18 wherein the means for raising and lowering said conical hub comprise a toothed rack projecting upwardly from and operatively connected to said drive shaft, a servomotor engaging said toothed rack for climbing movement therealong, and bracket means connecting said servomotor to said hub, whereby climbing movement of said servomotor along said rack will result in corresponding vertical movement of said hub.

20. The apparatus claimed in claim 3 wherein the means for propelling the increments of filling material from the hollow mandrel into the tubing comprises an air jet in said mandrel, valve means for opening and closing said air jet, and valve actuating means for opening and closing said valve means in timed relation to the rotation of said turret.

21. The apparatus claimed in claim 4 wherein the means associated with said mandrel and forming shoe for sealing together the overlapped marginal edges of the web comprise an adhesive applicator positioned to apply at least one narrow longitudinal filament of adhesive to a marginal side edge of the web immediately prior to the overlapping of the web edges to form the longitudinal seam, and a pressure roll overlying the mandrel and positioned to contact the longitudinal seam following its formation.

22. The apparatus claimed in claim 21 including a second roller mounted on said mandrel immediately beneath said pressure roll to contact the inner surface of the longitudinal seam of the tubed web.

23. The apparatus claimed in claim 22 including means for applying air under pressure to said pressure roller to cool it, a duct in said mandrel in communication with said second roller, and means for supplying air under pressure to said duct to cool said second roller.

24. The apparatus claimed in claim 5 wherein said adhesive printing means comprises an applicator roll adapted to be coated with adhesive, a dauber roll overlying said applicator roll, said dauber roll having at least one projecting fin thereon adapted to deflect the web into contact with the underlying applicator roll as the web passes between said rolls and said fin comes into tangential relationship with said applicator roll, means for rotating said applicator roll and said dauber roll in timed relation to each other and to the movement of the web, and guide roll means positioned to maintain the web out of contact with said applicator roll except when engaged by the fin on said dauber roll.

25. The apparatus claimed in claim 6 wherein said adhesive drying means comprises a rotatable drying drum about which the web passes, a plurality of heated drying bars mounted on the cylindrical surface of said drum at spaced apart intervals corresponding to the spacing between the transverse stripes of adhesive on the web, a first translation roll positioned to reverse the direction of web travel and guide the web into contact with the drum, and a second translation roll positioned to remove the web from the drum and again reverse its direction of travel, and means for rotating said drum in timed relation to the movement of the web.

26. The apparatus claimed in claim 25 including means for driving said first translation roll in time relation to the movement of the web, at least one recessed area in said first translation roll adapted to coincide with and span the transverse stripes of adhesive printed on the web.

* * * * *

UNITED STATES PATENT OFFICE

CERTIFICATE OF CORRECTION

PATENT NO. : 4,045,946

DATED : September 6, 1977

INVENTOR(S) : Jean E. Schaefer

It is certified that error appears in the above-identified patent and that said Letters Patent are hereby corrected as shown below:

Column 7, line 67, "33b" should read --23b--.

Column 11, line 64, "plug which" should read --plug 126 which--.

Signed and Sealed this

*Thirteenth* Day of *June 1978*

[SEAL]

*Attest:*

RUTH C. MASON
*Attesting Officer*

DONALD W. BANNER
*Commissioner of Patents and Trademarks*